US009273833B2

(12) United States Patent
Wilcox et al.

(10) Patent No.: US 9,273,833 B2
(45) Date of Patent: Mar. 1, 2016

(54) LED LIGHT FIXTURES WITH ARRANGEMENT FOR ELECTRICAL CONNECTION

(71) Applicant: Cree, Inc., Durham, NC (US)

(72) Inventors: Kurt Wilcox, Libertyville, IL (US); Andrew Bendtsen, Racine, WI (US); Dan Quella, Racine, WI (US)

(73) Assignee: Cree, Inc., Durham, NC (US)

( * ) Notice: Subject to any disclaimer, the term of this patent is extended or adjusted under 35 U.S.C. 154(b) by 185 days.

(21) Appl. No.: 14/070,116

(22) Filed: Nov. 1, 2013

(65) Prior Publication Data

US 2015/0124449 A1 May 7, 2015

(51) Int. Cl.

| | |
|---|---|
| ***F21V 5/00*** | (2015.01) |
| ***F21K 99/00*** | (2010.01) |
| ***F21V 5/04*** | (2006.01) |
| ***F21S 8/08*** | (2006.01) |
| ***F21V 29/76*** | (2015.01) |
| *F21Y 105/00* | (2006.01) |

(52) U.S. Cl.

CPC . *F21K 9/50* (2013.01); *F21S 8/086* (2013.01); *F21V 5/04* (2013.01); *F21V 29/767* (2015.01); *F21Y 2105/001* (2013.01)

(58) Field of Classification Search

CPC ..... F21K 9/50
USPC ..... 362/244
See application file for complete search history.

(56) References Cited

U.S. PATENT DOCUMENTS

| | | | |
|---|---|---|---|
| 3,860,829 | A | 1/1975 | Fabbri et al. |
| 4,071,749 | A | 1/1978 | Balogh |
| 4,156,891 | A | 5/1979 | Roche |
| 4,254,453 | A | 3/1981 | Mouyard et al. |
| 5,004,953 | A | 4/1991 | McDonald |

(Continued)

FOREIGN PATENT DOCUMENTS

| | | | |
|---|---|---|---|
| CN | 101093073 | A | 12/2007 |
| CN | 101101102 | A | 1/2008 |

(Continued)

OTHER PUBLICATIONS

Stanley Electric Co., Ltd. "Stanley LED for Street Light", brochure. Date: Aug. 2006.

(Continued)

*Primary Examiner* — Anh Mai
*Assistant Examiner* — Hana Featherly
(74) *Attorney, Agent, or Firm* — Jansson Munger McKinley & Kirby Ltd.

(57) ABSTRACT

An LED light fixture includes a heat sink structure, at least one LED board in thermal engagement with the heat sink structure, the at least one LED board having at least one LED emitter thereon, and an on-board connector on the LED board for connecting electrical wiring to the LED emitter(s). At least one enclosing member forms with the heat sink an interior space enclosing a corresponding LED board, the rigid enclosing member defining a wiring aperture therethrough in alignment with the on-board connector. The LED light fixture also has an exterior wireway structure including a one-piece duct which has an end portion engaged with the wiring aperture and forms a channel for wires to the on-board connector. The wireway structure further includes a single-piece rigid cover secured with respect to the enclosing member and enclosing the duct.

42 Claims, 17 Drawing Sheets

(56) References Cited

U.S. PATENT DOCUMENTS

| | | | |
|---|---|---|---|
| 5,303,124 | A | 4/1994 | Wrobel et al. |
| 5,633,564 | A | 5/1997 | Edwards et al. |
| 5,676,455 | A | 10/1997 | Johnson et al. |
| 5,890,794 | A | 4/1999 | Abtahi et al. |
| 5,909,062 | A | 6/1999 | Krietzman |
| 5,988,829 | A | 11/1999 | Holder et al. |
| 6,045,232 | A | 4/2000 | Buckmaster et al. |
| 6,522,263 | B2 | 2/2003 | Jones |
| 6,565,238 | B1 | 5/2003 | Pyrtle |
| 6,648,496 | B1 | 11/2003 | Elghoroury et al. |
| 6,657,862 | B2 | 12/2003 | Crocker et al. |
| 6,758,580 | B1 | 7/2004 | Verfuerth |
| 6,784,351 | B2 | 8/2004 | Hauptmann et al. |
| 6,784,357 | B1 | 8/2004 | Wang |
| 6,815,724 | B2 | 11/2004 | Dry |
| 6,942,360 | B2 | 9/2005 | Chou et al. |
| 6,942,361 | B1 | 9/2005 | Kishimura et al. |
| 6,957,905 | B1 | 10/2005 | Pritchard et al. |
| 6,984,061 | B1 | 1/2006 | Soderberg et al. |
| 7,036,961 | B2 | 5/2006 | Defouw et al. |
| 7,090,370 | B2 | 8/2006 | Clark et al. |
| 7,114,830 | B2 | 10/2006 | Robertson et al. |
| 7,153,004 | B2 | 12/2006 | Galli |
| 7,178,941 | B2 | 2/2007 | Roberge et al. |
| 7,199,529 | B2 | 4/2007 | Vernon-Dier |
| 7,234,844 | B2 | 6/2007 | Bolta et al. |
| 7,244,042 | B1 | 7/2007 | Bieberdorf |
| D551,379 | S | 9/2007 | Maxik |
| 7,267,459 | B2 | 9/2007 | Matheson |
| 7,278,761 | B2 | 10/2007 | Kuan |
| 7,303,301 | B2 | 12/2007 | Koren et al. |
| 7,503,669 | B2 | 3/2009 | Rizkin et al. |
| 7,513,639 | B2 | 4/2009 | Wang |
| 7,566,147 | B2 | 7/2009 | Wilcox et al. |
| 7,771,087 | B2 | 8/2010 | Wilcox et al. |
| 8,092,049 | B2 | 1/2012 | Kinnune et al. |
| 8,313,222 | B2 | 11/2012 | Kinnune et al. |
| 8,425,071 | B2 | 4/2013 | Ruud et al. |
| 8,622,584 | B2 | 1/2014 | Kinnune et al. |
| 2002/0113244 | A1 | 8/2002 | Barnett et al. |
| 2003/0048608 | A1 | 3/2003 | Crocker et al. |
| 2004/0036629 | A1 | 2/2004 | Jones et al. |
| 2004/0114356 | A1 | 6/2004 | Galli |
| 2004/0257006 | A1 | 12/2004 | Beeman et al. |
| 2005/0128752 | A1 | 6/2005 | Ewington et al. |
| 2005/0174762 | A1 | 8/2005 | Fogerlie |
| 2006/0250803 | A1 | 11/2006 | Chen |
| 2007/0086196 | A1 | 4/2007 | Wong |
| 2007/0115666 | A1 | 5/2007 | Thomas et al. |
| 2008/0037239 | A1 | 2/2008 | Thomas et al. |
| 2008/0080162 | A1 * | 4/2008 | Wilcox et al. ..... 362/20 |
| 2008/0080189 | A1 | 4/2008 | Wang |
| 2008/0080196 | A1 | 4/2008 | Ruud et al. |
| 2009/0268477 | A1 | 10/2009 | Zheng et al. |

FOREIGN PATENT DOCUMENTS

| | | | |
|---|---|---|---|
| CN | 101101103 | A | 1/2008 |
| CN | 101101104 | A | 1/2008 |
| CN | 101101106 | A | 1/2008 |
| CN | 101101107 | A | 1/2008 |
| CN | 101105268 | A | 1/2008 |
| CN | 101105278 | A | 1/2008 |
| EP | 1431653 | A2 | 6/2004 |
| EP | 1760393 | A1 | 3/2007 |
| EP | 1906081 | A1 | 4/2008 |
| JP | 2005150003 | A | 6/2005 |
| WO | 9833007 | A1 | 7/1998 |
| WO | 9957945 | A1 | 11/1999 |
| WO | 0216826 | A1 | 2/2002 |
| WO | 03044870 | A1 | 5/2003 |
| WO | 03089841 | A1 | 10/2003 |
| WO | 2006060905 | A1 | 6/2006 |

OTHER PUBLICATIONS

"LED Light Sources" product description. Aavid Thermalloy. Date: Copyright 2006.

Lithonia Lighting. Installation Instructions—Single and Twin Mounting Bar (RJ5210060). Date: Jun. 1999.

Lithonia Lighting. Industrial Accessories—Wireguards Accessories (ACCI). Date: 1999.

W.A.C. Lighting. W.A.C. Lighting Catalog (e.g., cover, pp. 3, 5-6, 15, 23, 34). Date: 1998.

Molex. Specification sheet for Part No. 43045-0418. 2 pages. Date: Sep. 3, 2013.

Molex. Specification sheet for Part No. 43025-0400. 2 pages. Date: Sep. 3, 2013.

* cited by examiner

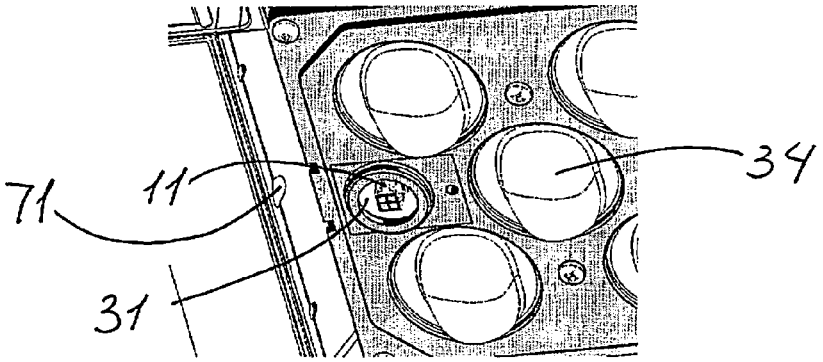
*FIG. 6*
*FIG. 7*
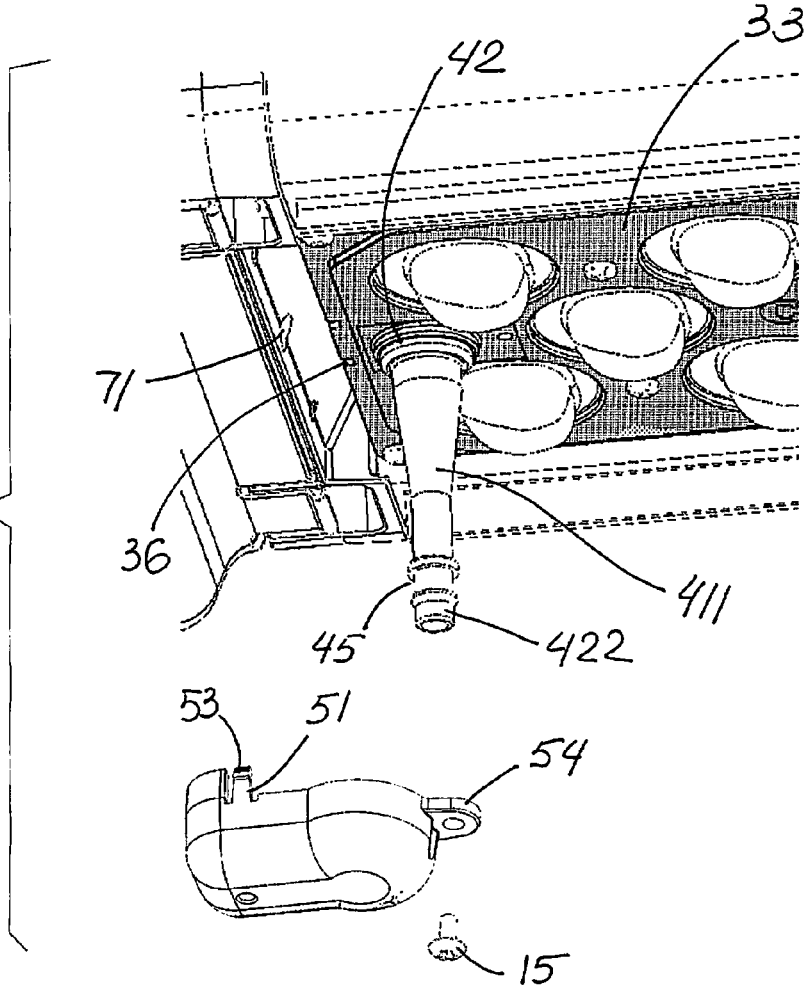

LED LIGHT FIXTURES WITH ARRANGEMENT FOR ELECTRICAL CONNECTION

FIELD OF THE INVENTION

This invention relates to light fixtures and, more specifically, to light fixtures having LED emitters as light sources and, still more specifically, to arrangements for electrical connection.

BACKGROUND OF THE INVENTION

In recent years, the use of light-emitting diodes (LEDs) in development of light fixtures for various common lighting purposes has increased, and this trend has accelerated as advances have been made in the field. Indeed, lighting applications which previously had typically been served by fixtures using what are known as high-intensity discharge (HID) lamps are now being served by LED light fixtures. Such lighting applications include, among a good many others, roadway lighting, factory lighting, parking lot lighting, and commercial building lighting.

High-luminance light fixtures using LEDs as light source present particularly challenging problems. One particularly challenging problem for high-luminance LED light fixtures relates to achieving manufacturing efficiencies and ease of assembly while at the same time producing high quality sturdy light fixtures that fully comply with applicable standards, including UL and other regulatory standards.

One desirable characteristic of certain LED light fixtures is modular flexibility permitted by LED-array modules. However, manufacture of modular fixtures presents a challenge with respect to the electrical connection to and between LED-array modules. In some prior LED light fixtures, assembly required alignment of wiring-related parts that was difficult to achieve and the failure of which would complicate assembly and add risk of imperfections in sealing arrangements intended to protect the LEDs—and thus extend the useful life of the LED lighting products. Achieving improvements without expensive additional structure and apparatus is much desired.

In summary, a major consideration in the development of high-luminance LED light fixtures for various high-volume applications is controlling product cost even while delivering improved light-fixture performance and extended fixture life. And, improvement in electrical connection to and between LED-array modules would be valuable contributions to achieving low cost and high quality.

SUMMARY OF THE INVENTION

The present invention relates to improved LED light fixtures which provide the advantages of low-cost manufacture with high product quality and excellent performance, by virtue of improvement in electrical connection to and between LED-array modules.

The inventive LED light fixture includes a heat sink structure and at least one LED board in thermal engagement with the heat sink structure. The at least one LED board has at least one LED emitter thereon. An on-board connector is disposed on the LED board for connecting electrical wiring to the LED emitter(s). At least one enclosing member (e.g., an "optical member" as described later in this specification or an assemblage also described later in this specification) forms with the heat sink an interior space enclosing a corresponding LED board. Such interior space, between the heat sink and the enclosing member, may be environmentally sealed. The electrical connections to the LED board, or in some cases the electrical connections to the LED board and between plural LED boards in plural interior spaces, are of importance in this invention.

The enclosing member defines a wiring aperture therethrough which is in alignment with the on-board connector on the LED board and is for passing wires from the outside, which is open to environmental elements, through the enclosure into the interior space. An exterior wireway structure includes a one-piece flexible duct which has an end portion engaged with the wiring aperture and which forms a channel for wires to the on-board connector.

The end portion of the duct may be in sealing engagement with the wiring aperture. In some embodiments, the end portion of the flexible duct has an outward lip defining a groove receiving the edge of the wiring aperture, thus forming a seal thereabout.

The enclosing member may be rigid. In certain embodiments, the wireway structure further includes a single-piece rigid cover secured with respect to the enclosing member and enclosing the flexible duct. The rigid cover may include an attaching portion detachably securing the rigid cover to the enclosing member. In some embodiments, the attaching portion includes a resilient tab terminating with a hook positioned and configured for snap-engagement with the enclosing member. The rigid cover may further be secured with respect to the enclosing member by a fastener extending through the rigid cover into the enclosing member. In some of such embodiments, the fastener extends into a closed-end fastener receptor formed in the enclosing member.

In certain embodiments, the enclosing member comprises at least one optical portion corresponding to and over the at least one LED emitter. In some of such embodiments, the enclosing member is an optical member which has the at least one optical portion (lens) and an flange portion thereabout. Each optical member may have a plurality of optical portions (lenses), each of which is aligned with a corresponding LED light source on the LED light board. One example of such optical member is described in co-owned patent application Ser. No. 13/843,649, filed on Mar. 15, 2013, the entire contents of which are incorporated herein by reference. The wiring aperture may be formed in the flange portion.

The LED light fixture may include a housing with a wire-passage opening through which wires extend to the on-board connector. The housing may have a chamber with the wire-passage opening therefrom. The chamber may enclose electronic LED power circuitry, including one or more LED drivers.

In some of such embodiments, the one-piece flexible duct is a source-to-board duct and has a second end in engagement with the wire-passage opening of the housing. This allows wires from the chamber to pass though the duct to the on-board connector.

In certain embodiments, the LED light fixture includes at least two "lighting sets" adjacent to one another. Each lighting set includes one of the enclosing members and its corresponding LED board. One of the lighting sets may be proximal to the wire-passage opening of the housing. The source-to-board duct extends between the wire-passage opening of the housing and the proximal lighting set. Another lighting set in such LED light fixture may be adjacent to the proximal lighting set; and, if there are three lighting sets, a third lighting set will be adjacent to the second lighting set.

In such embodiments, each adjacent pair of lighting sets includes a board-to-board on-board connector for each lighting set of such pair. Such board-to-board on-board connectors are proximal to one another. Each enclosing member of each adjacent pair of such lighting sets may define a board-to-board wiring aperture which is positioned over the corresponding board-to-board on-board connector. Certain of such embodiments include a board-to-board flexible duct which forms a channel for passing wires between the board-to-board on-board connectors of the adjacent pair of the lighting sets. The board-to-board flexible duct has two end portions each in engagement with one of such board-to-board wiring apertures.

In some of such embodiments, each end portion of the board-to-board flexible duct has an outward lip defining a groove receiving the edge of the corresponding board-to-board wiring aperture thereby forming a seal thereabout.

The wireway structure may also include a single-piece board-to-board rigid cover enclosing the board-to-board flexible duct and secured with respect to the enclosing members of the adjacent pair of the lighting sets. In certain embodiments, the board-to-board rigid cover includes an attaching portion securing the rigid cover to the enclosing members of the adjacent pair of the lighting sets. The attaching portion may include a resilient tab, as described above, but in such board-to-board arrangement may terminate with a hook positioned and configured for simultaneous snap-engagement with both enclosing members of the adjacent lighting sets.

Each such board-to-board rigid cover may also include means at each end thereof to facilitate securement to the two adjacent enclosing members. Such securement may be by two fasteners, one at each end of the rigid cover extending through the board-to-board rigid cover into the corresponding enclosing member, as described above.

In embodiments in which the enclosing member(s) is/are optical member(s), the wiring apertures may be formed in the flange portion of each optical members. Where there are a pair of adjacent lighting sets, the board-to-board flexible duct engages the flange portion of each of the adjacent optical members. In such embodiments, the board-to-board rigid cover may be configured for simultaneous snap-engagement with flange portions of both of the adjacent optical members.

In certain embodiments, the at least one LED emitter comprises an array of LED light sources spaced along the board. Each of a plurality of lenses is positioned over a corresponding one of the LED light sources. In some of such embodiments, each LED light source comprises an array of LEDs.

In some embodiments with two or more lighting sets adjacent to one another, the proximal board has by-pass circuitry which extends from the source-to-board on-board connector to the board-to-board on-board connector for connection to the adjacent LED board. In such embodiments, the adjacent boards are electrically connected in parallel with respect to one another.

In certain aspects of the present invention, an LED light fixture includes a mounting structure, at least one LED emitter secured with respect to the mounting structure and defining a light-emission side of the mounting structure, and conductive paths from the at least one LED emitter to a quick-connect connector which is secured with respect to the mounting structure for connecting electrical wiring to the LED emitter(s). At least one enclosing member forms with the mounting structure an interior space enclosing the at least one LED emitter. The enclosing member may define a wiring aperture therethrough in alignment with the quick-connect connector. Such LED light fixture has an exterior wireway structure forming a channel for wires to the quick-connect connector.

With this arrangement, such channel is spaced from the mounting structure on the light-emission side thereof. If the mounting structure is a heat sink, use of the exterior wireway structure facilitates thermal connections between the LED emitter(s) and the heat sink. Such structure may also lower manufacturing costs by simplifying assembly and in some cases saving material costs.

In certain embodiments, the exterior wireway structure has an electrically-insulating inner surface. In some embodiments, the exterior wireway structure has an outer reflective surface which allows reflection of LED emitter light impacting the exterior wireway structure. In some cases, the inner surface is electrically insulating and the outer surface is reflective.

In some embodiments, the exterior wireway structure includes a one-piece duct which has an end portion engaged with the wiring aperture and which forms a channel for wires to the quick-connect connector. Such one-piece duct may be of a flexible material, which can also have the aforementioned electrically-insulating inner surface. The exterior wireway structure may also include a single-piece rigid cover enclosing the flexible duct. Such single-piece cover may have the aforementioned reflective outer surface.

In some other embodiments, the at least one LED emitter and the quick-connect connector are on an LED board which includes the conductive paths.

In alternative embodiments, the LED emitter(s) may be secured directly to the mounting structure. In such embodiments, the quick-connect connector is secured directly to the corresponding LED emitter. One example of such LED emitters is a high-density XLamp® CXA LED arrays manufactured by Cree, Inc.

In certain embodiments, the mounting structure is a heat sink which is in thermal engagement with the LED emitter(s). In the embodiments with the LED board, the LED board is in thermal engagement with the heat sink.

It should be understood that some versions of LED emitters may not require that the mounting structure be a heat sink. In such embodiments, the mounting structure may be supporting the LED emitter(s) but not be a heat conductive structure.

It will be noted that the terms "over" and "under" are used in describing relative positions of certain elements of the light fixtures of this invention. Such terms are used with reference to part orientations in a manufacturing method used, and not necessarily with reference to gravity or to the position of a light fixture when installed for use.

In descriptions of the invention, including in the claims below, the terms "comprising," "including" and "having" (each in their various forms) and the term "with" are each to be understood as being open-ended, rather than limiting, terms.

BRIEF DESCRIPTION OF THE DRAWINGS

FIG. 6 is a fragmentary perspective view showing details of a lighting set proximal to a wire-passage opening of the housing.

FIG. 7 is an exploded perspective view of a source-to-board wireway with one end of a flexible duct engaged with a wire aperture of an enclosing member.

DETAILED DESCRIPTION OF EXEMPLARY EMBODIMENTS

Figure 1:
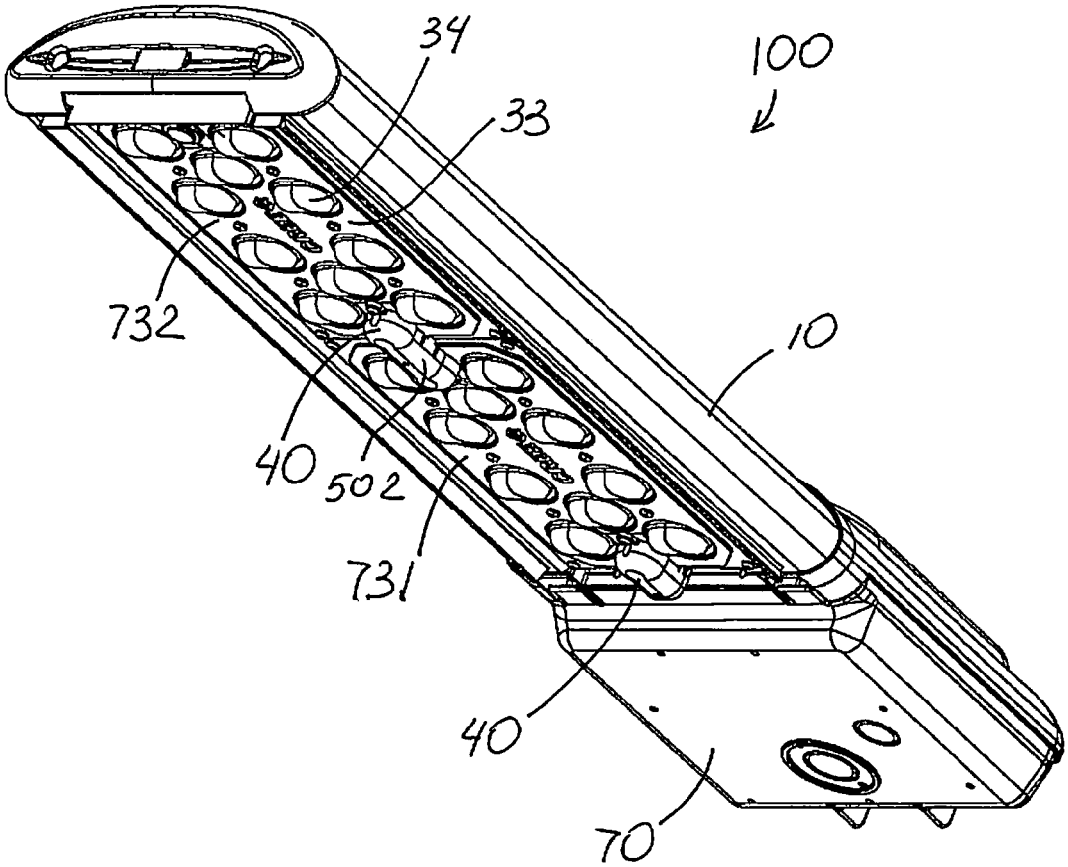
FIG. 1 is a perspective view from below of an LED light fixture incorporating an LED apparatus according to an exemplary embodiment of this invention.
Figure 2:
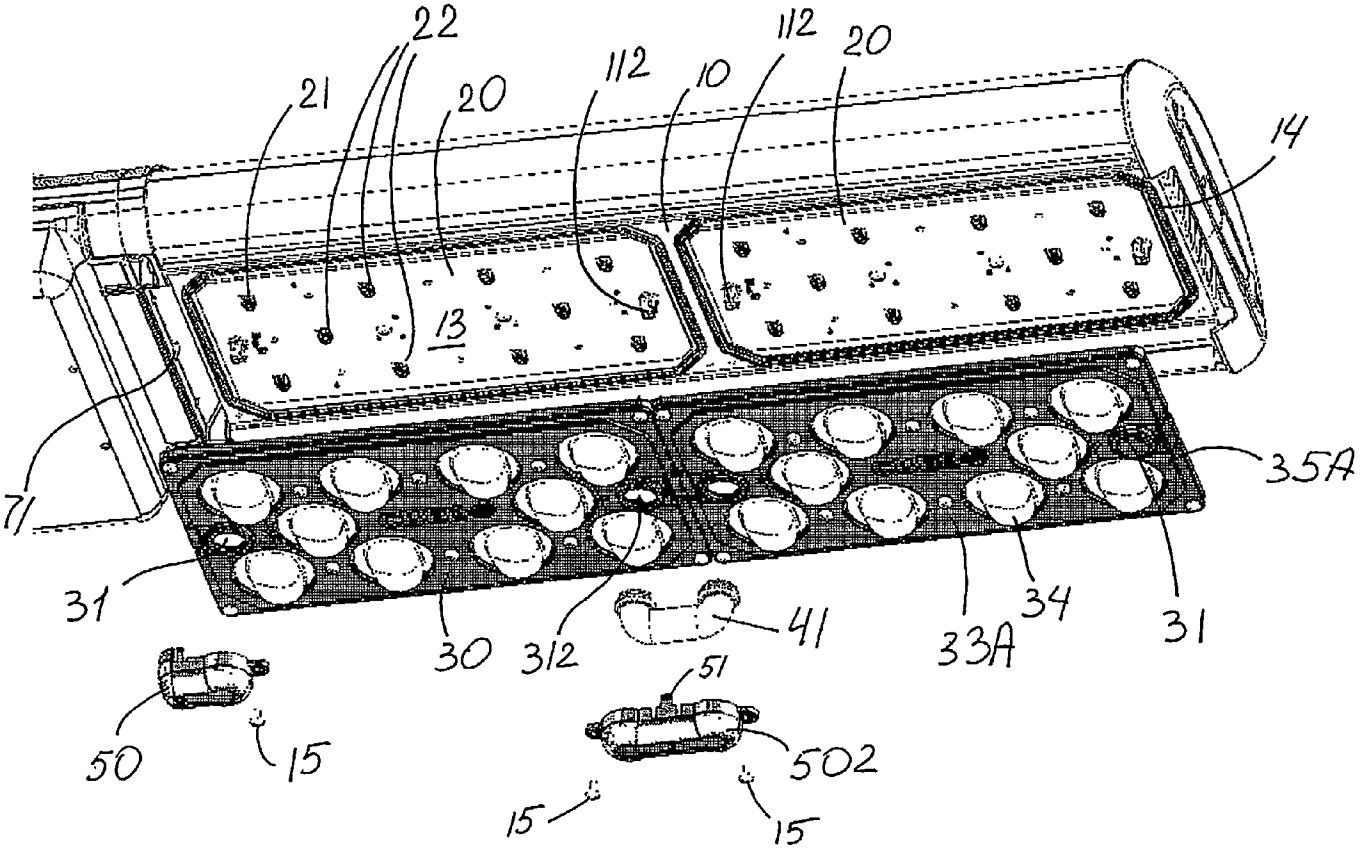
FIG. 2 is a fragmentary exploded perspective view from below of the LED light fixture of FIG. 1, with a source-to-board wireway partially illustrated.
Figure 3:
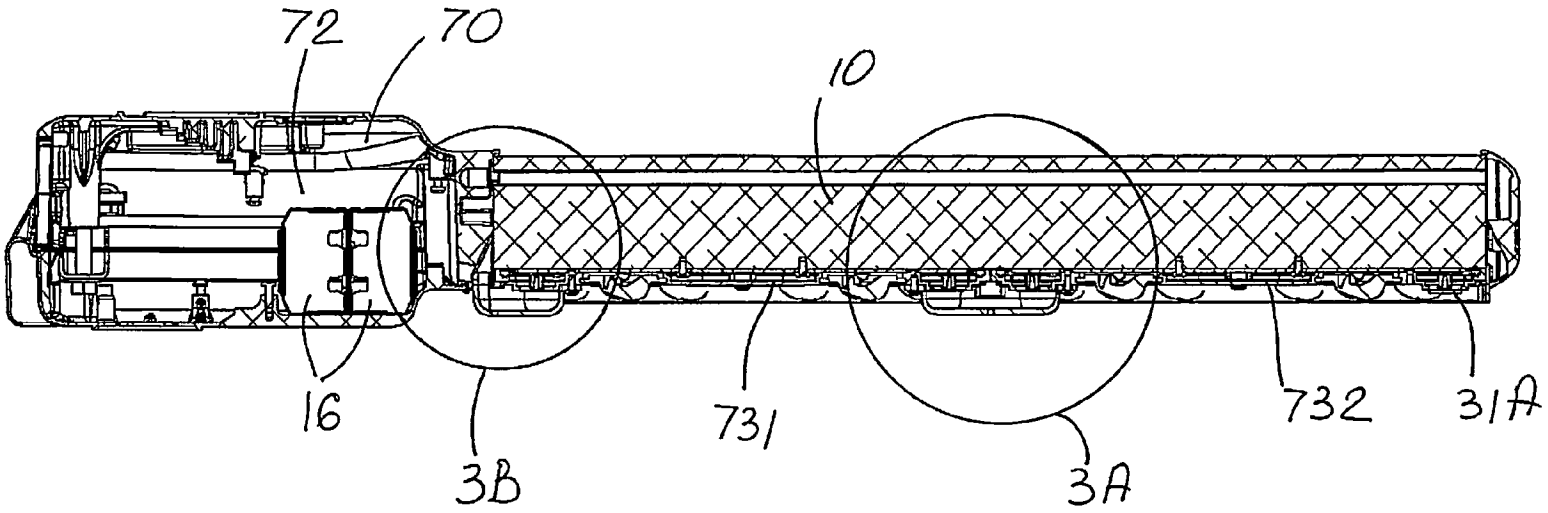
FIG. 3 is a cross-sectional view of the LED light fixture of FIG. 1, the section being taken along lines 3-3 shown in FIG. 4.
Figure 8:
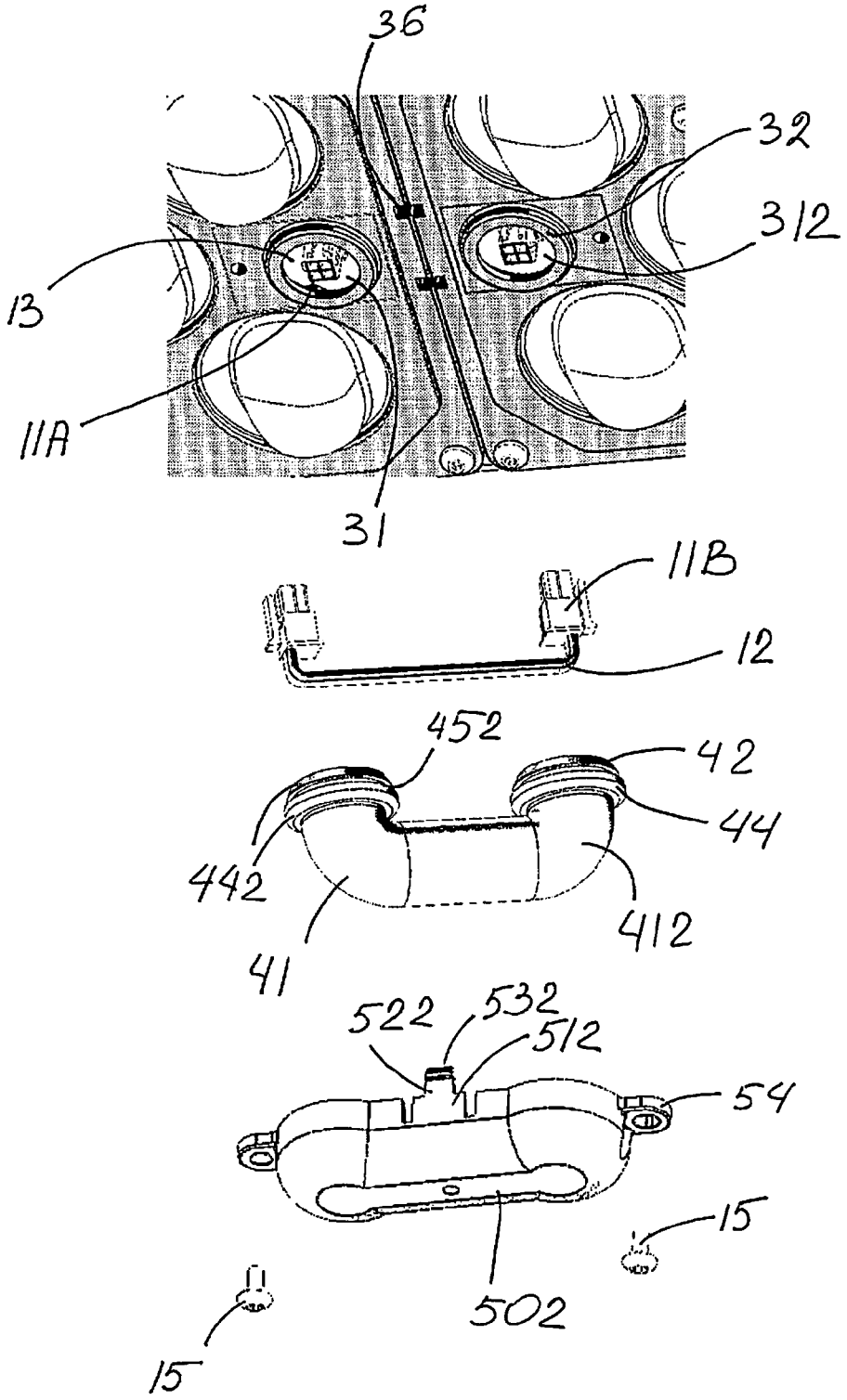
FIG. 8 is an exploded perspective view of a board-to-board wireway, including wires with male connector members.
Figure 9:
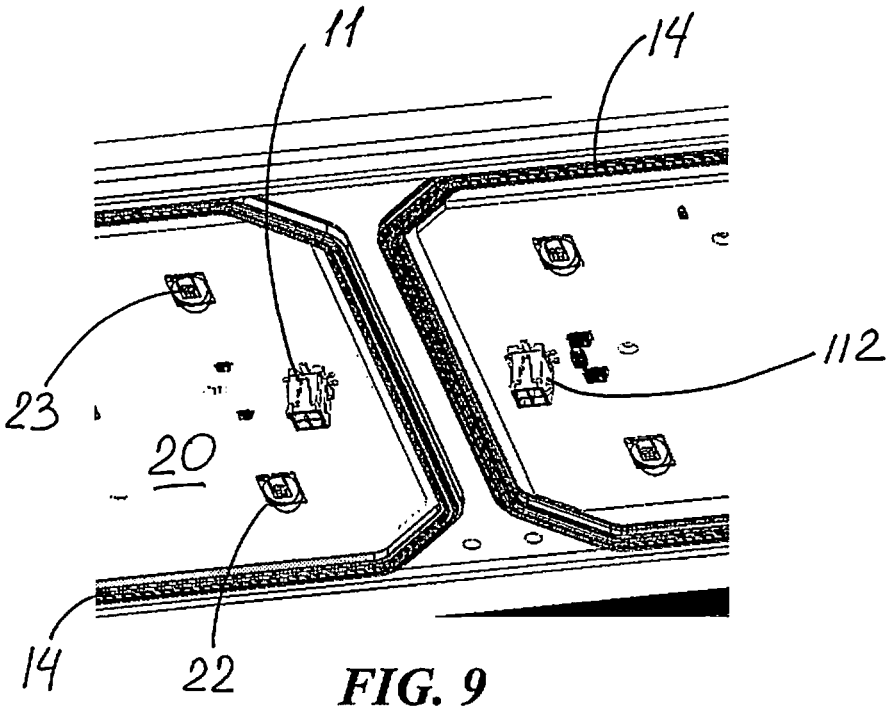
FIG. 9 is a fragmentary perspective view showing detail of LED boards of adjacent lighting sets as used in FIG. 8 with female connector members.

FIGS. 1-10 illustrate an exemplary embodiment of an improved LED light fixture 100. As seen in FIGS. 1-3, LED light fixture 100 includes a heat sink structure 10 and at least one LED board 20 in thermal engagement with heat sink structure 10. LED board 20 is shown to have an LED emitter 21 with an array of LED light sources 22 spaced along board 20. FIG. 9 shows LED light source 22 including an array of LEDs 23. Alternative examples of LED light sources are shown in FIGS. 14-19 and described later in this section.

Figure 11:
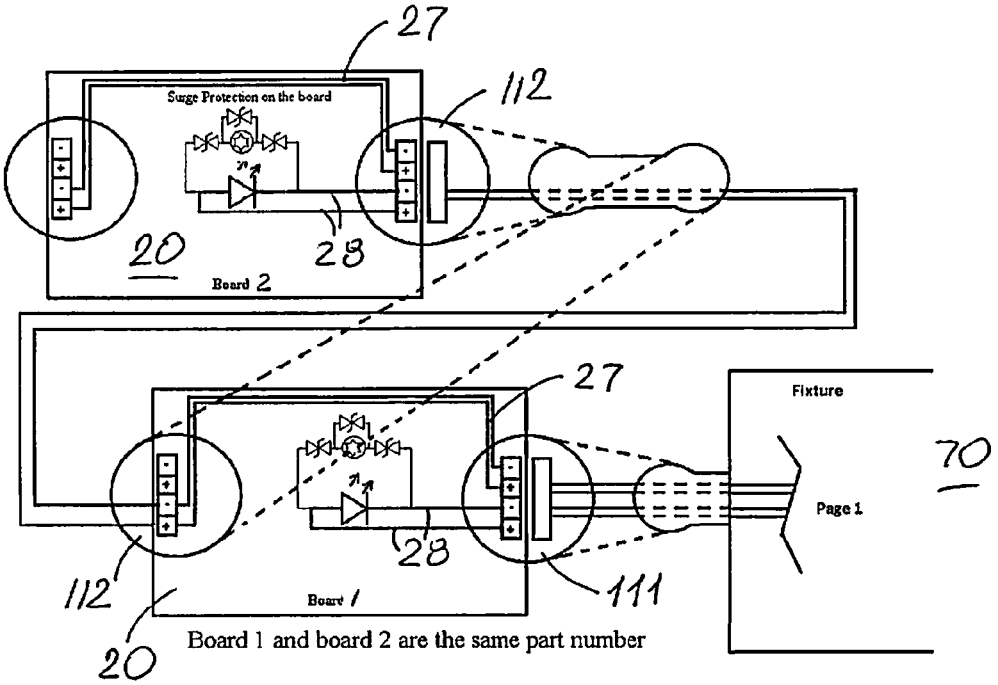
FIG. 11 is a schematic illustration of an exemplary electric circuit for a light fixture utilizing the present invention for electrical connection of two adjacent identical LED boards.
Figure 12:
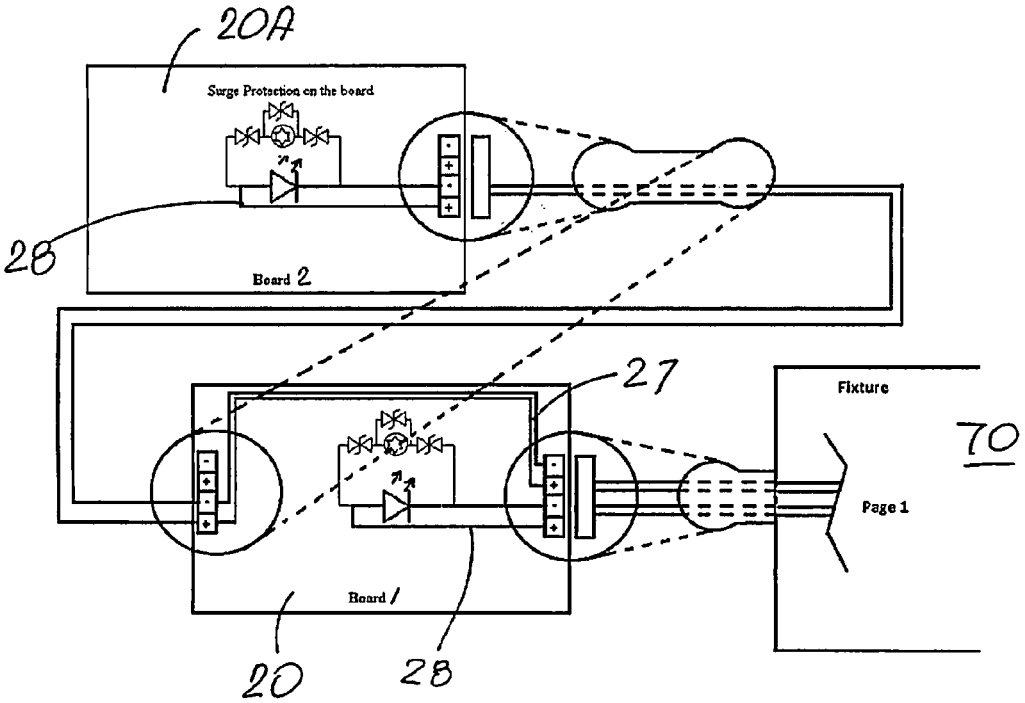
FIG. 12 is a schematic illustration of an exemplary electric circuit for a light fixture utilizing the present invention for electrical connection of two adjacent LED boards, one of which is configured for circuit termination.
Figure 13:
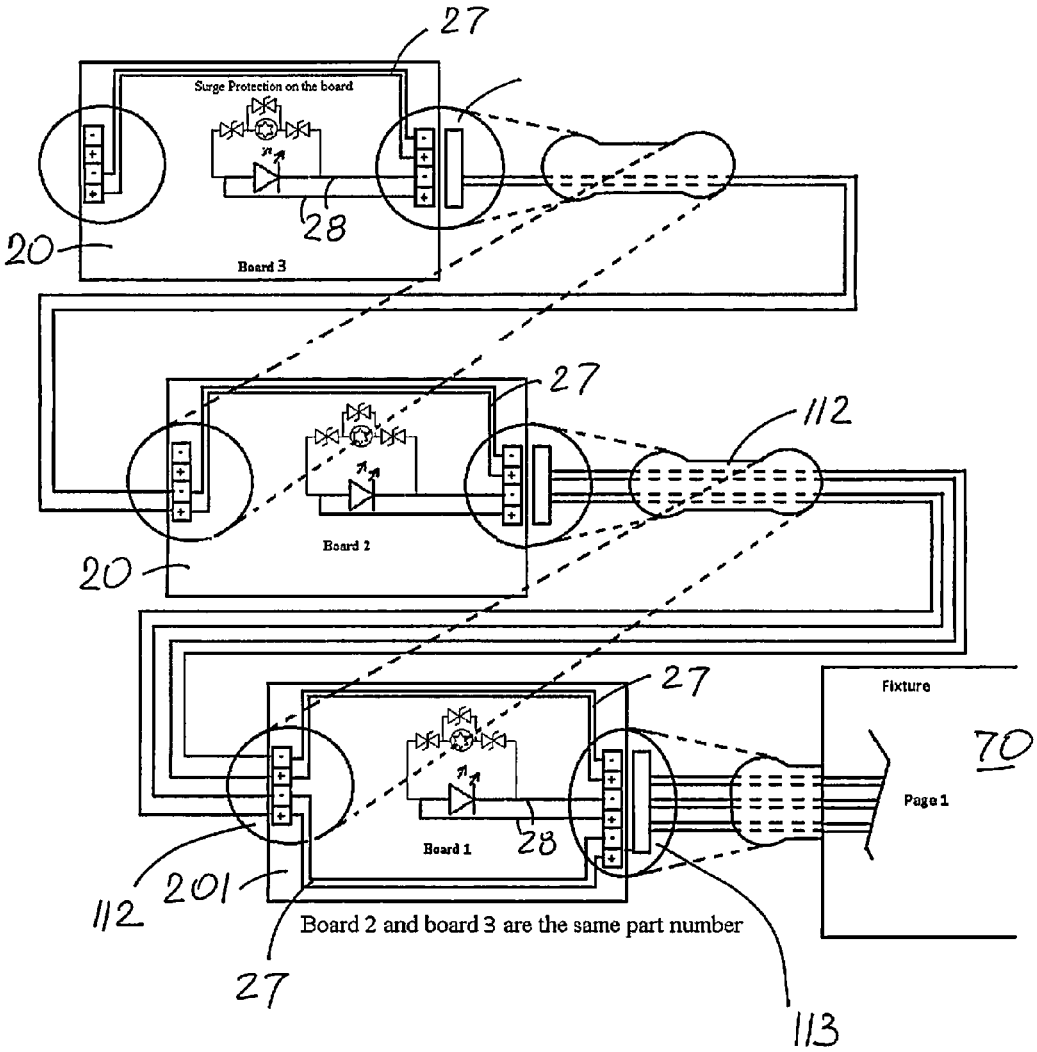
FIG. 13 is a schematic illustration of an exemplary electric circuit for a light fixture utilizing the present invention for electrical connection of three LED boards, including an LED board which is configured for source-to board connection and has circuitry for connection of the other two LED boards which are adjacent and identical to one another.

An on-board connector 11 is disposed on LED board 20 for connecting electrical wiring 12 to LED emitter 21. FIGS. 8 and 9 best show connectors 11 as vertical on-board connectors such as connectors manufactured by Molex Incorporated under its trademark MicroFit. As best seen in FIG. 8, connectors 11 include a female member 11A on LED board 20 and a male member 11B secured to wiring 12. Such connectors provide a desirable range of power distribution and are configured and dimensioned to require a minimal footprint area on the LED board. Such connectors accommodate a plurality of circuits, some examples of which are schematically shown in FIGS. 11-13 described further in this section.

An enclosing member 30 forms with heat sink 10 an interior space 13 enclosing corresponding LED board 20. FIGS. 2, 3 and 9 show a gasket 14 positioned around the perimeter of LED boards 20 for sandwiching between enclosing member 30 and heat sink 10 to environmentally seal interior space 13.

Enclosing member 30 defines a wiring aperture 31 therethrough. As best seen in FIGS. 6 and 8, wiring aperture 31 is in alignment with on-board connector 11 for passing wires 12 through enclosure member 30 into environmentally-sealed interior space 13 from the outside which is open to environmental elements.

Figure 3A:
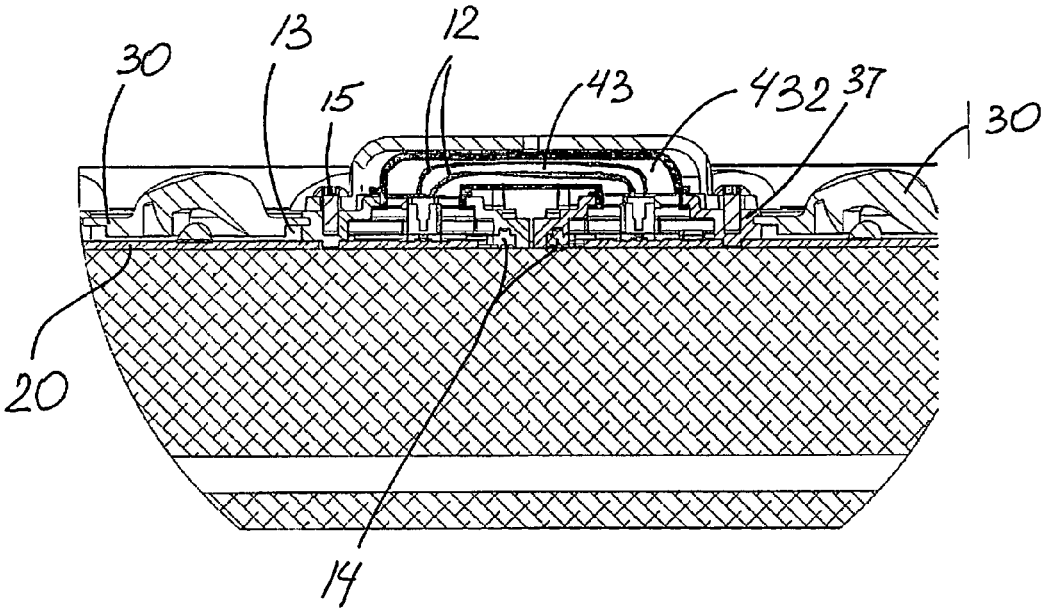
FIG. 3A is an enlarged fragment of FIG. 3, as indicated in FIG. 3.
Figure 3B:
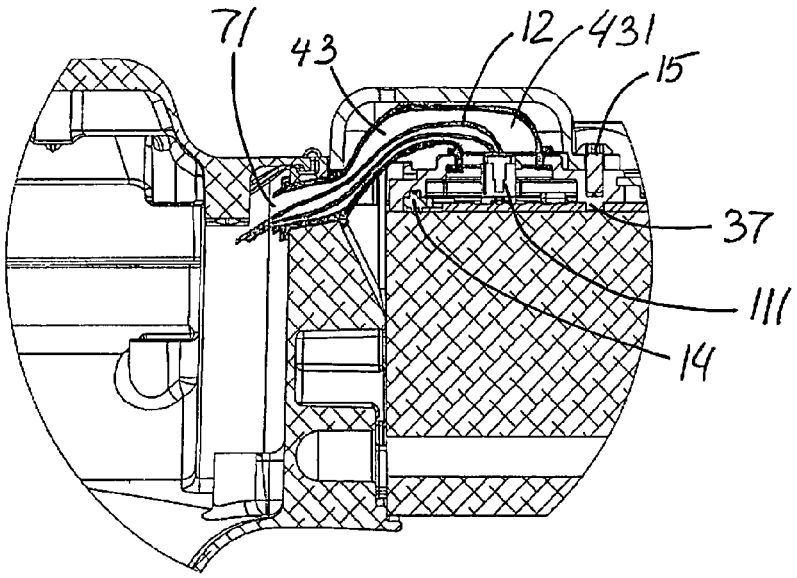
FIG. 3B is another enlarged fragment of FIG. 3, as indicated in FIG. 3.
Figure 4:
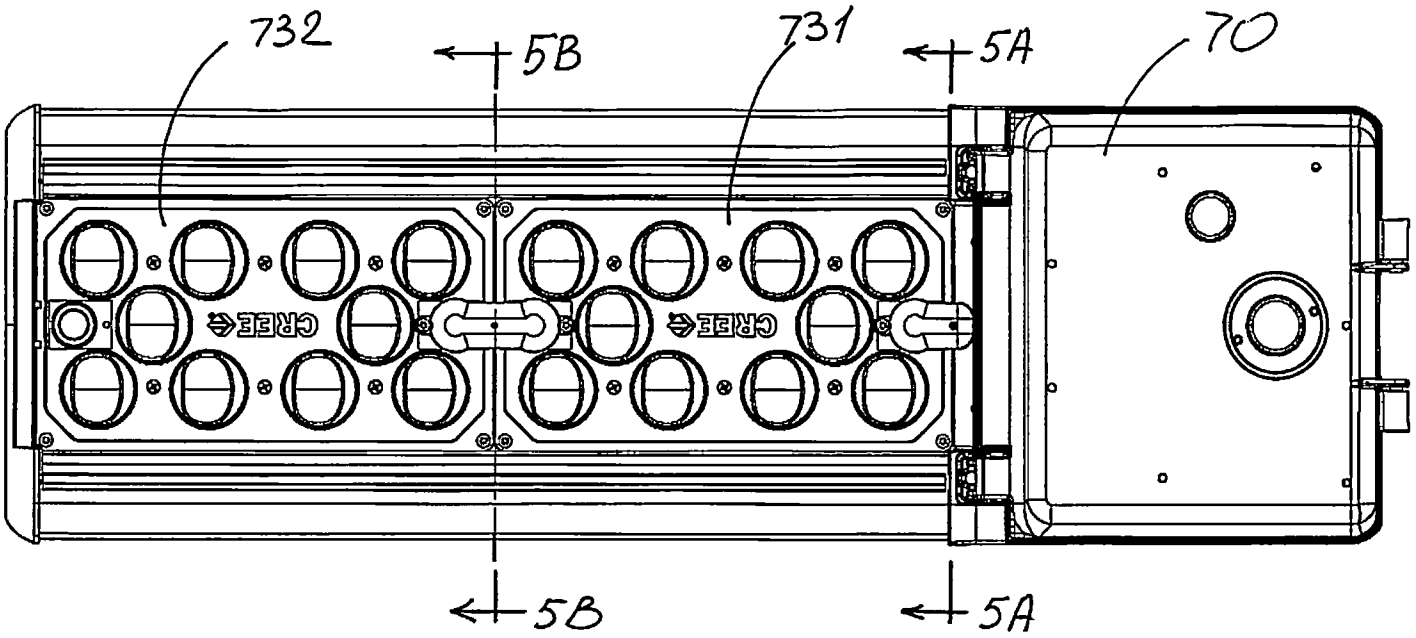
FIG. 4 is a bottom plan view of the LED light fixture of FIG. 1.
Figure 5A:
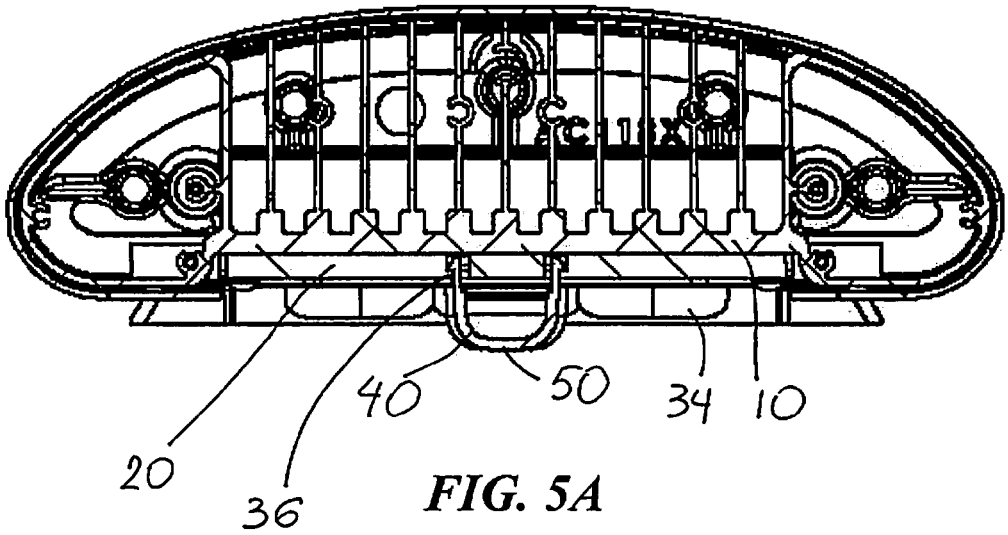
FIG. 5A is a cross-sectional view of the LED light fixture of FIG. 1, the section being taken along lines 5A-5A shown in FIG. 4.
Figure 5B:
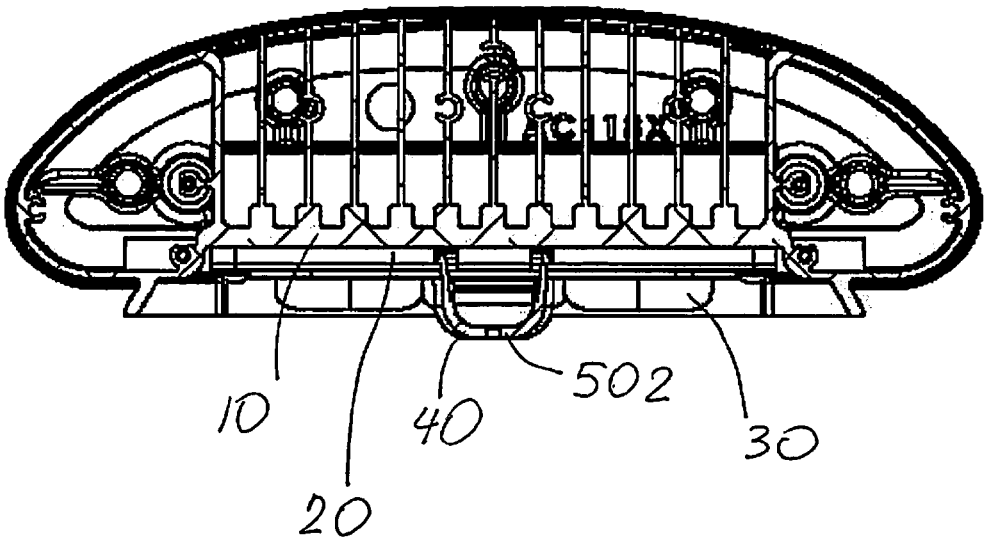
FIG. 5B is a cross-sectional view of the LED light fixture of FIG. 1, the section being taken along lines 5B-5B shown in FIG. 4.
Figure 10:
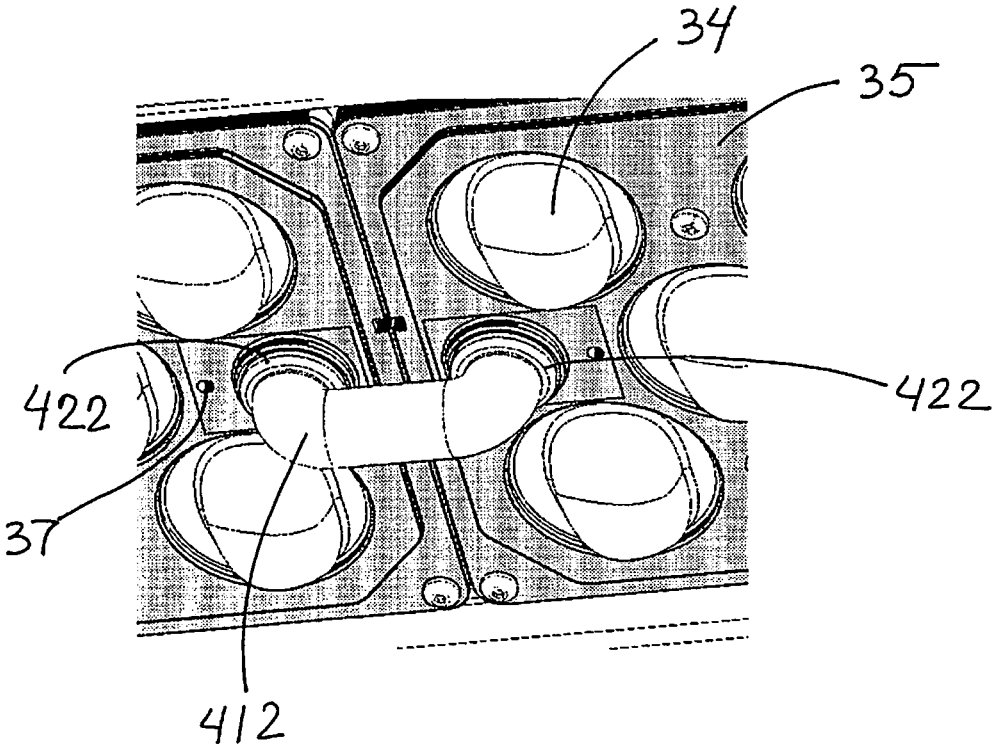
FIG. 10 is a fragmentary perspective view showing each of two ends of a board-to-board flexible duct engaged with one of adjacent wire apertures of enclosing members of adjacent lighting sets shown in FIG. 8.

FIGS. 6-8 and 10 best show an exterior wireway structure 40 including a one-piece flexible duct 41 which has an end portion 42 engaged with wiring aperture 31 and which forms a channel 43 for wires 12 to on-board connector 11, as best seen in FIGS. 3A and 3B. FIGS. 3, 7 and 10 show end portion 42 of duct 41 in sealing engagement with wiring aperture 31. As seen in FIGS. 3A, 3B, 7 and 8, end portion 42 of flexible duct 41 has an outward lip 44 defining a groove 45 which receives edge 32 of wiring aperture 31 thereby forming a seal thereabout.

Enclosing member 30 is shown as a rigid optical member 33 which has an optical portion 34 and a flange portion 35 about optical portion 34. FIGS. 1-3 show one exemplary embodiment of enclosing member 30A as optical member 33A which includes a plurality of optical portions 34. Each optical portion 34 corresponds to and over one of LED light sources 22 of LED emitter 21. As described in co-owned patent application Ser. No. 13/843,649, optical member 33A has a plurality of optical portion 34A formed of a first polymeric material and flange portion 35A of a second polymeric material. The second polymeric material of flange portion 35A overlaps with and is molded onto to the first polymeric material lens of optical portions 34A. Flange portion 35A forms wiring aperture 31A therethrough.

Figure 20:
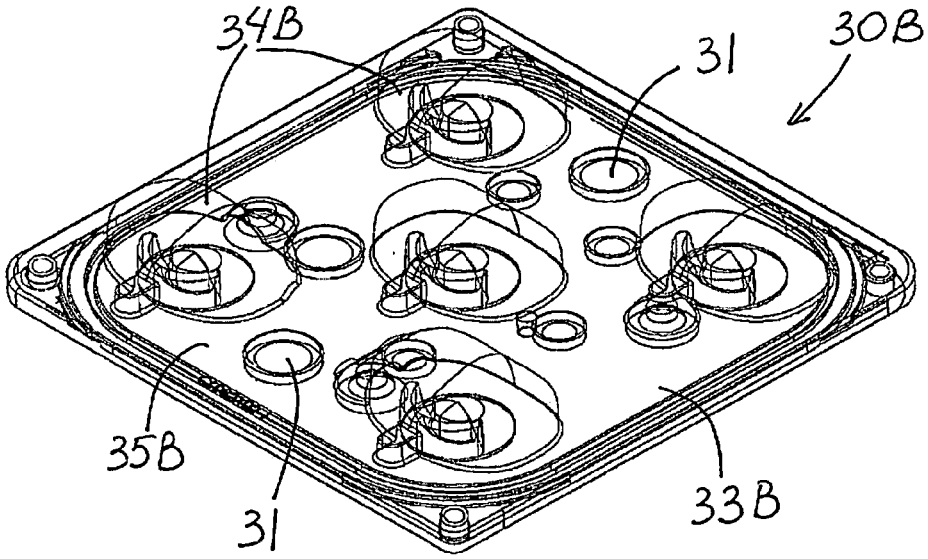
FIG. 20 is a perspective view of an alternative embodiment of an enclosing member being a single-piece optical member with a plurality of optical portions and a surrounding flange portion being made of a single polymeric material.
Figure 21:
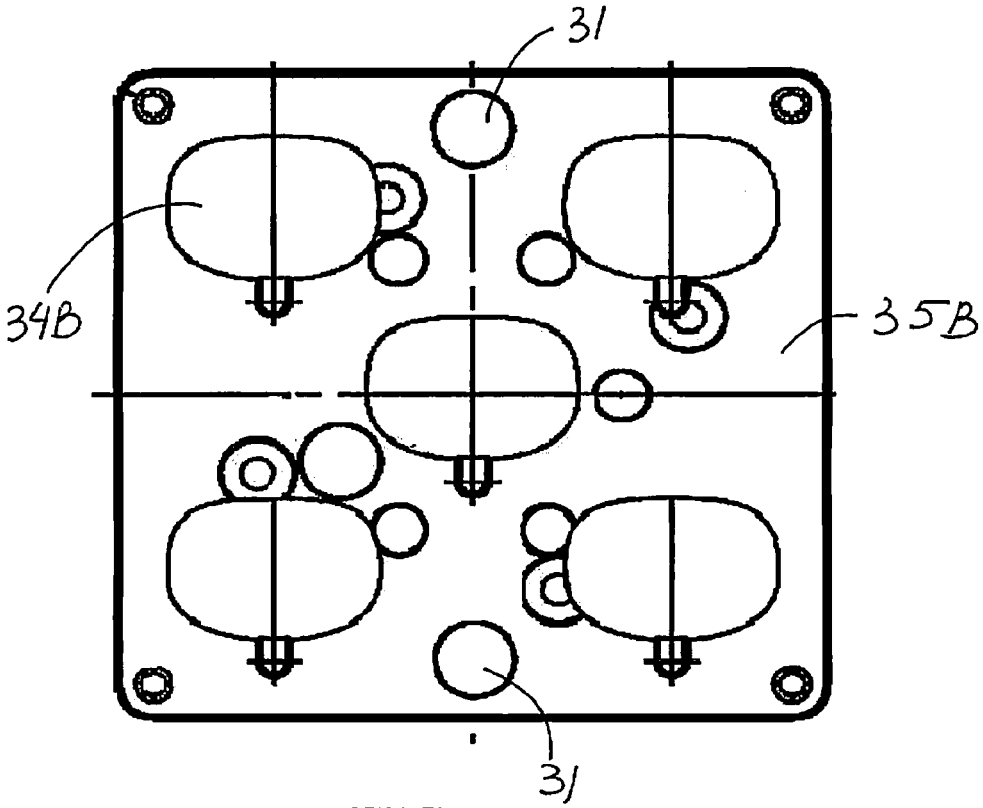
FIG. 21 is a top plan view of the single-piece optical member of FIG. 20.

FIGS. 20 and 21 show an alternative embodiment of enclosing member 30B as a single-piece optical member 33B which includes a plurality of optical portions 34B surrounded by a flange portion 35B. Single-piece optical member 33B may be made of a single polymeric material.

Figure 22:
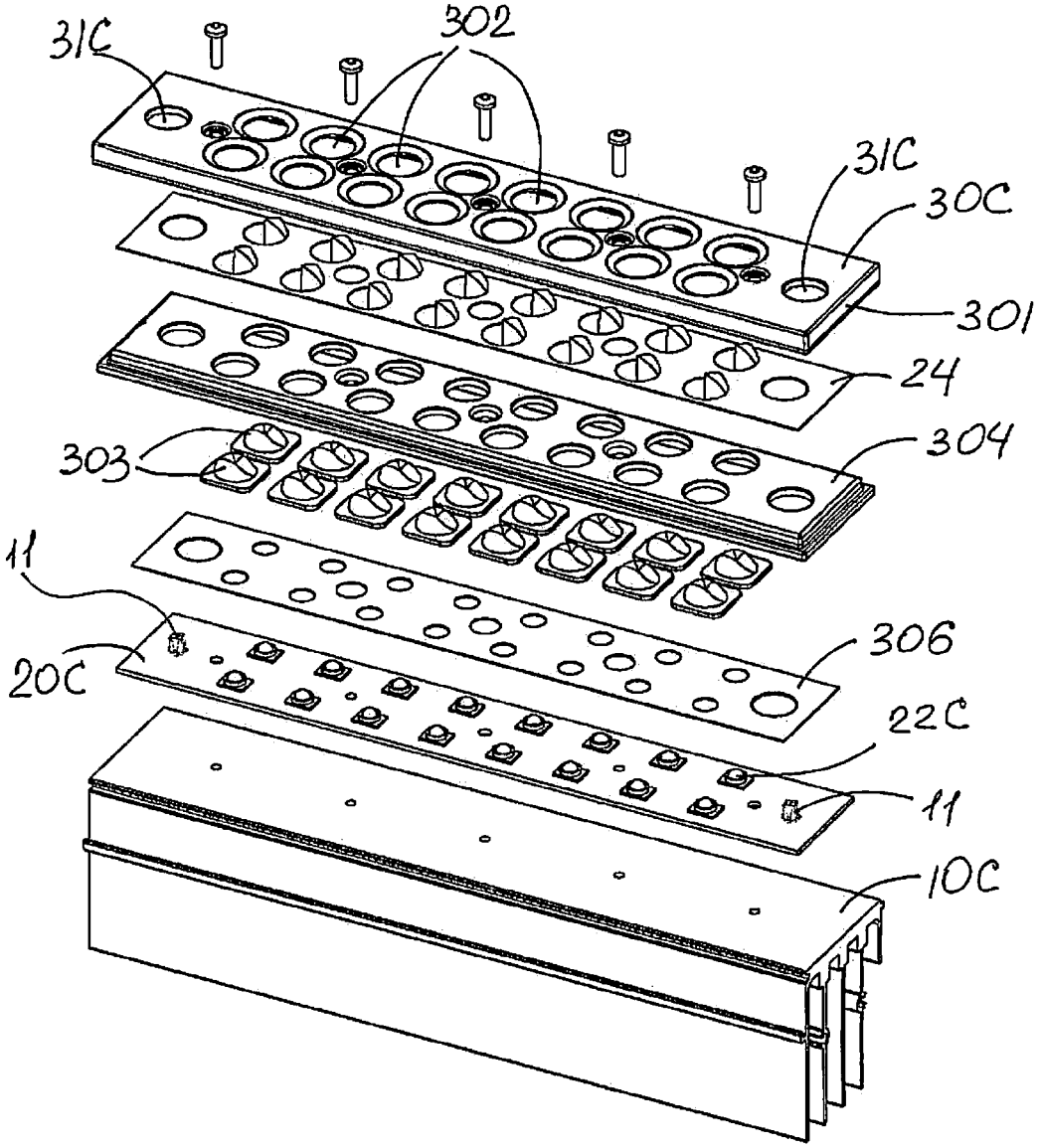
FIG. 22 is an exploded perspective view of another alternative of an enclosing member being a rigid cover member which defines a plurality of optical apertures each aligned with a respective one of a plurality of LED light sources.

FIG. 22 shows yet another alternative embodiment of the present invention. Such embodiment includes an enclosing member 30C which is a rigid cover member 301 which defines a plurality of optical apertures 302 each aligned with a respective one of a plurality of lenses 303 shown as separate and discrete pieces, but persons skilled in the art will appreciate that lenses 303 can be formed together as a single piece. Each lens member 303 is aligned over a corresponding one of LED light sources 22C. FIG. 22 shows rigid cover member 301 forming wiring apertures 31C for engagement with end portion 42 of flexible duct 41.

FIG. 22 also illustrates a gasket member 304 in the shape of a layer which forms a plurality of openings each aligned with a corresponding one of LED light sources 22C. Gasket member 304 is sandwiched between cover member 301 and LED board 20C. FIG. 22 further illustrates a shield member 24, in the form of a layer, positioned under cover member 301.

As is also seen in FIG. 22, a safety layer 306 is positioned preferably immediately over LED light sources 22C and includes a plurality of openings each sized to receive the corresponding one of light sources 22C. Safety layer 306 is for enclosure of electrical elements on LED board 20C and includes a plurality of openings each sized to permit light from the corresponding one of light sources 22C and also to prevent finger-contact of electrical elements on the mounting board when the light-transmission portion is not present. Safety barrier 306 may be made of an acceptable material which satisfies applicable specifications related to material behavior such as hot-wire ignition, horizontal burning, and high-current arcing resistance, all of which are set forth in relevant UL standards.

As seen in FIG. 22, each of the layers of the illustrated embodiment defines a wiring aperture aligned with and over on-board connector 11 disposed on LED board 20C.

FIGS. 1-8 show wireway structure 40 including a single-piece rigid cover 50 secured with respect to enclosing member 30 and enclosing flexible duct 41. As best seen in FIGS. 2, 7 and 8, rigid cover 50 includes an attaching portion 51 which detachably secures rigid cover 50 to enclosing member 30. FIGS. 7 and 8 show attaching portion 51 including a resilient tab 52 which terminates with a hook 53 positioned and configured for snap-engagement with enclosing member 30. It is also seen in FIGS. 7 and 8 that enclosing member 30 has an edge 36 which is configured for snap engagement by hook 53 of rigid cover 50. FIGS. 1 and 2 show that rigid cover 50 is further secured with respect to enclosing member 30 by fasteners 15 which extending through an outward tab 54 of rigid cover 50 into enclosing member 30. FIGS. 3, 3A and 3B show fastener 15 extend into a closed-end fastener receptor 37 formed in enclosing member 30.

FIGS. 1-4 show LED light fixture 100 including a housing 70 with a wire-passage opening 71 through which wires 12 extend to on-board connector 11. It is seen in FIG. 3 that housing 70 has a chamber 72 with wire-passage opening 71 from chamber 72. It is also seen in FIG. 3 that chamber 72 encloses LED drivers 16 of electronic LED power circuitry.

FIGS. 3A and 7 illustrate one-piece flexible duct 411 as a source-to-board duct which has a second end 422 in engagement with wire-passage opening 71 of housing 70 such that wires 12 from chamber 72 pass though duct 411 to on-board connector 111 which is positioned adjacent to wire-passage opening 71.

FIGS. 1-4 best illustrate LED light fixture 100 including a pair of lighting sets 731 and 732 adjacent to one another. It is best shown in FIGS. 2 and 3 that each of lighting sets 731 and 732 includes one enclosing member 30 and its corresponding LED board 20. FIGS. 1-3 show that lighting set 731 is proximal to wire-passage opening 71 of housing 70 and that source-to-board duct 411 extends between wire-passage opening 71 of housing 70 and proximal lighting set 731.

FIGS. 1-3 and 8-10 show that each adjacent pair of the lighting sets 731 and 732 includes a board-to-board on-board connector 112 for each lighting set of such pair. FIG. 9 best shows board-to-board on-board connectors 112 are proximal to one another. Each enclosing member 30 of adjacent lighting sets 731 and 732 define a board-to-board wiring aperture 312 which is positioned over the corresponding board-to-board on-board connector 112. FIGS. 8 and 10 best show a board-to-board flexible duct 412 which forms a channel 432 for passing wires 12 between board-to-board on-board connectors 112 of adjacent pair of lighting sets 731 and 732. As seen in FIG. 10, board-to-board flexible duct 412 has two end portions 422 each in engagement with one of adjacent board-to-board wiring apertures 312. Each end portion 422 of board-to-board flexible duct 412 has an outward lip 442 which defines a groove 452 receiving edge 32 of corresponding board-to-board wiring aperture 312 such that flexible duct 412 forms a seal about aperture 312.

FIGS. 3A and 8 also show that wireway structure 40 includes a single-piece board-to-board rigid cover 502 which encloses board-to-board flexible duct 412 and is secured with respect to optical members 33 of the adjacent pair of lighting sets 731 and 732. Resilient tab 522 of attaching portion 512 is configured such that hook 532 is positioned and configured for simultaneous snap-engagement with edges 32 of optical members 33 of adjacent lighting sets 731 and 732. It is further seen in FIGS. 3A and 4 that board-to-board rigid cover 502 is further secured with respect to each of optical members 33 by fasteners 15 each of which extends through a hole in respective outward tab 54 of board-to-board rigid cover 502 into closed-end fastener receptor 37 of corresponding optical members 33.

FIGS. 14-19 show light source 22 including at least one light-emitting diode (LED) 23. Light source 22 may be a light emitter in the form of an LED package which has a primary lens 24 over the at least one LED 23. In such embodiments, optical portion 34 is a secondary lens 17 placed over primary lens 24. Light emitter 21 may be of the type illustrated in FIGS. 16-18 which show an LED package with single LED 23 on a submount 26 and hemispheric primary lens 24D coaxially overmolded on submount 26 over LED 23.

Figure 14:
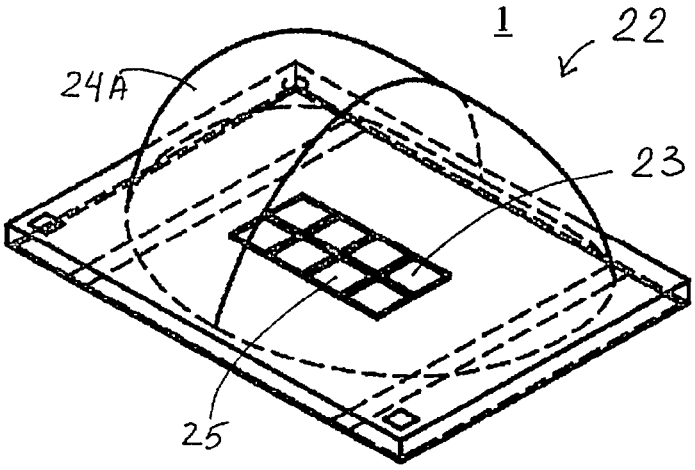
FIG. 14 is an enlarged perspective view of one example of an LED light source as an LED package including an array of eight LEDs on a submount and an asymmetric primary lens overmolded over the LED array.
Figure 15:
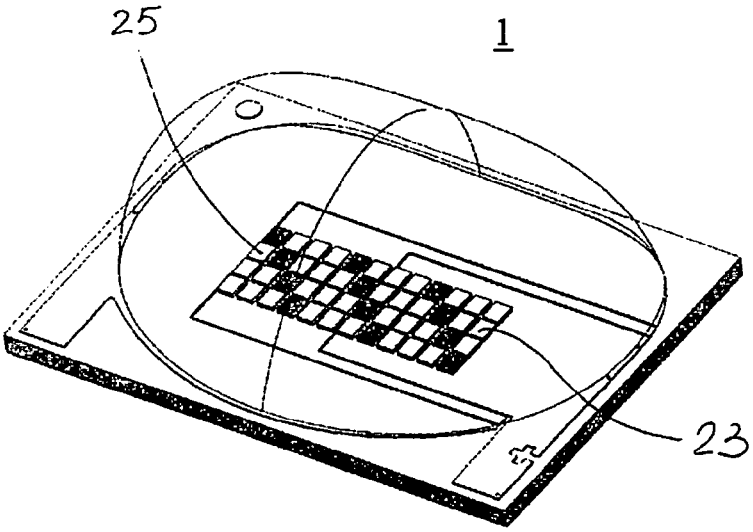
FIG. 15 is an enlarged perspective view of another example of an LED light source as an LED package including an array of forty-eight LEDs on a submount and an asymmetric primary lens overmolded over the LED array.
Figure 16:
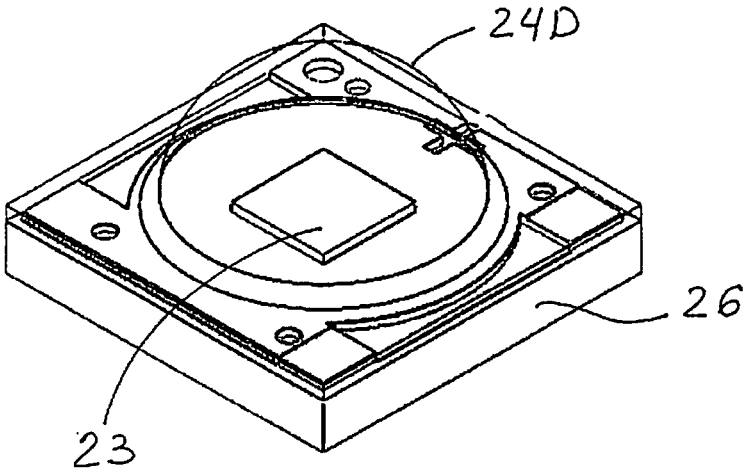
FIG. 16 is an enlarged perspective of yet another example of an LED light source as an LED package which has a single LED on a submount with a hemispheric primary lens overmolded over the LED.
Figure 17:
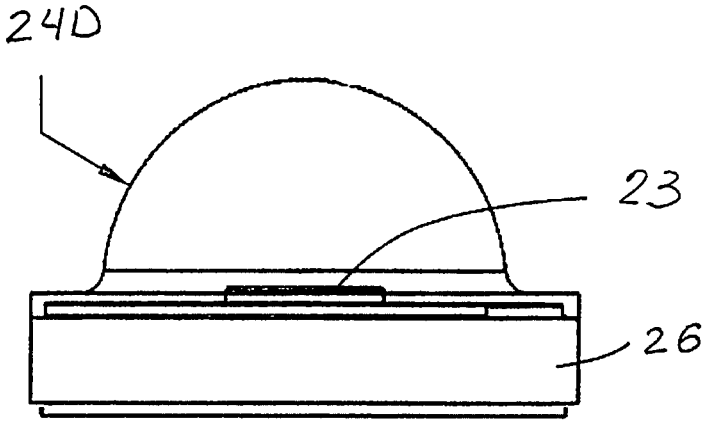
FIG. 17 is an enlarged side view of the LED package of FIG. 16.
Figure 18:
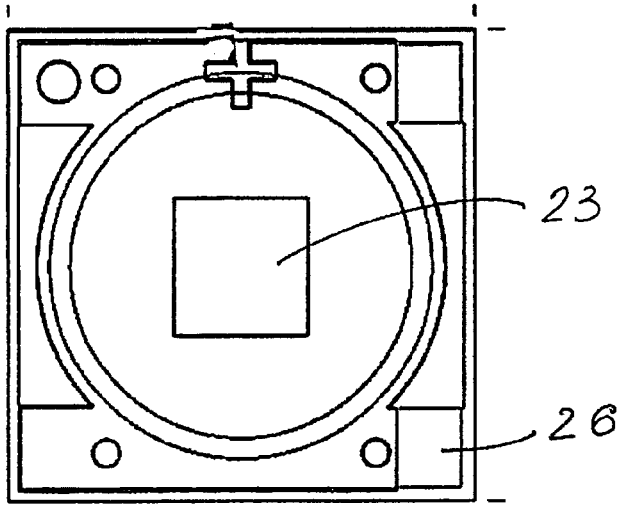
FIG. 18 is an enlarged top view of the LED package of FIG. 16.

FIGS. 14 and 15 illustrate exemplary LED packages each including an array of LEDs 23 on an LED-populated area 25 which has an aspect ratio greater than 1, and primary lens 24 being overmolded on a submount 26 over LED-populated area 25. It is seen in FIG. 15 that the array may include LEDs 23 emitting different-wavelength light of different colors such as including red LEDs along with light green or other colors to achieve natural white light. Light emitters of the type as LED packages shown in FIGS. 14 and 15 are described in detail in application Ser. No. 13/441,558, filed on Apr. 6, 2012, and in application Ser. No. 13/441,620, filed on Apr. 6, 2012. The contents of both applications are incorporated herein by reference in their entirety.

Figure 19:
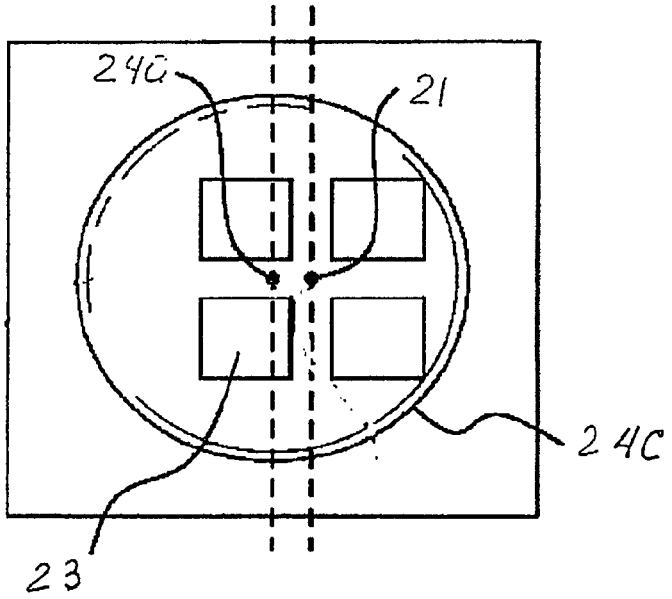
FIG. 19 is an enlarged top view of another exemplary LED light source as an LED package including an array of four LEDs on a submount and a hemispheric primary lens overmolded over the LED array such that the axis of the primary lens is offset from the axis of the LED array.

FIGS. 14, 15 and 19 illustrate versions of LED light emitter 21 configured to refract LED-emitted light in a forward direction 1 (i.e., toward front 1). In each of these LED packages, the LED array defines an emitter axis. FIGS. 14 and 15 illustrate primary lens 24A configured to refract LED-emitted light forward. FIG. 19 shows hemispheric primary lens 24C having a centerline 240 offset from the emitter axis. It should be understood that for higher efficiency, LED emitter 21 may have a primary lens having both its centerline offset from the emitter axis and also being shaped for refraction of LED-emitted light toward preferential side 1. In FIGS. 14 and 15, primary lens 24A is shown as asymmetric.

FIGS. 11-13 illustrate examples of electrical circuitry utilizing the present invention. FIG. 11 shows an example of electrical connection of two adjacent identical LED boards 20. Each of LED boards 20 are shown to include a bypass circuit 27 which extends from source-to-board on-board connector 111 to board-to-board on-board connector 112 such that adjacent LED boards 20 are electrically connected in parallel.

Figure 23:
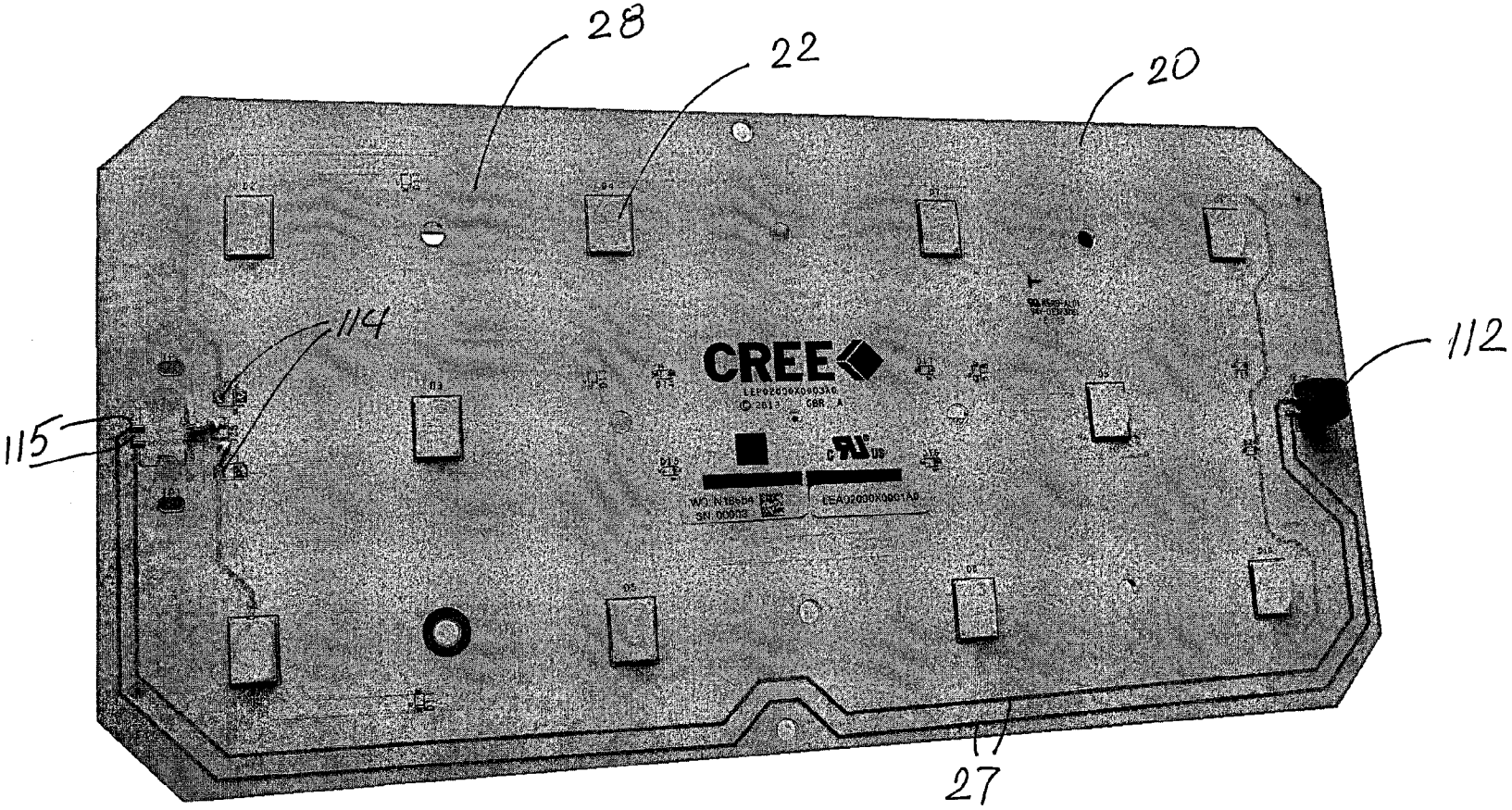
FIG. 23 is a perspective view of one embodiments of an LED board with an electric circuit being printed circuit thereon and including a by-pass circuitry.

FIG. 23 illustrates an example of LED board 20 including a working circuit 28 connecting LED light sources 22 on board 20 to connection points 114 with source-to-board on-board connector 111. LED board 20 is shown to also include bypass circuit lines 27 which extend from connection points 115 for source-to-board on-board connector 111 in parallel with respect to circuitry 28. As seen in FIGS. 11 and 23, bypass circuit lines 27 extend to board-to-board on-board connector 112 to provide electrical connection to the adjacent LED board. In this embodiment, as is also seen in FIGS. 11 and 23, source-to-board on-board connector 111 is configured for connection with two pairs of wires received from a power source—one pair being connected to working circuit 28 and the second pair being connected to bypass circuit 27.

FIG. 12 shows another example of electrical circuitry for parallel connection of two adjacent LED boards. In this example only LED board 20, which is proximal to fixture housing 70, includes a bypass circuit 27. FIG. 12 shows adjacent LED board 20A being configured for circuit termination.

FIG. 13 schematically illustrates parallel connection of three LED boards, including an LED board 201 which is proximal to fixture housing 70 and includes two bypass circuit lines 27 extending from source-to-board on-board connector 113. In this example, source-to-board on-board connector 113 is configured for connection with three pairs of wires received from a power source—one pair being connected to working circuit 28 on board 201, each of the other two pairs of wires being connected to one of bypass circuits 27 on board 201 and extending to board-to-board on-board connector 112 on board 201. These two pairs of wires are shown to connect to a second board-to-board on-board connector 112 which is on a first of LED boards 20 distal from the fixture housing, such first LED board 20 being adjacent to LED board 201. One of such two pairs of wires is then connected to working circuit 28 on first distal LED board 20. The other pair of wires is connected to bypass circuit 27 on first LED board 20 for connection to a second distal LED board 20. FIG. 13 shows first and second distal LED boards 20 being identical, but with bypass circuit 27 printed on the second distal LED board 20 being left without any wire connection. Such combination is convenient in that one type of LED board is used. It should be understood that the second distal LED board 20 can be configured for circuit termination as LED board 20A in FIG. 12.

It is also seen in FIGS. 1-4 that enclosing member 30 has a capped wiring aperture 31A aligned over a connector or a location for a connector at an end of LED board 20 which is most distal from housing 70. Such capped wiring aperture 31A may be opened if further wiring connection is required. Alternatively, enclosing member 30 may be continuously closed without any apertures.

While the principles of this invention have been described in connection with specific embodiments, it should be understood clearly that these descriptions are made only by way of example and are not intended to limit the scope of the invention.

The invention claimed is:

1. In an LED apparatus of the type comprising at least one optical member disposed over at least one LED emitter thereon, the optical member including (a) at least one optical portion corresponding to and over the at least one LED emitter and (b) a flange portion about the at least one optical portion, the improvement comprising:

at least one on-board connector configured for connection with electrical wiring for powering the LED emitter(s);

the optical-member flange portion defining an aperture therethrough positioned over the at least one on-board connector; and a wireway structure comprising a one-piece flexible duct with an end portion in engagement with the flange aperture, the duct forming a channel for passing wires to the on-board connector.

2. The apparatus of claim 1 wherein the end portion of the duct is in sealing engagement with the flange aperture.

3. The apparatus of claim 2 wherein the end portion of the flexible duct has an outward lip defining a groove receiving the edge of the flange aperture thereby forming a seal thereabout.

4. The apparatus of claim 1 wherein the wireway structure further comprises a single-piece rigid cover secured with respect to the optical-member flange portion and enclosing the flexible duct.

5. The apparatus of claim 4 wherein the rigid cover includes an attaching portion detachably securing the rigid cover to the optical-member flange portion.

6. The apparatus of claim 5 wherein the attaching portion includes a resilient tab terminating with a hook positioned and configured for snap-engagement with the optical-member flange portion.

7. The apparatus of claim 6 wherein the rigid cover is further secured with respect to the flange portion by a fastener extending through the rigid cover into the flange portion.

8. The apparatus of claim 7 wherein the fastener extends into a closed-end fastener receptor formed in the flange portion.

9. The apparatus of claim 1 as part of a light fixture that includes (a) a housing defining a chamber with a wire-passage opening through which wires extend from the chamber and (b) a heat sink secured with respect to the housing and in thermal-communicating engagement with the LED board, the one-piece flexible duct being a source-to-board duct and having a second end portion in engagement with the wire-passage opening of the housing, whereby wires from the chamber pass though the duct to the on-board connector.

10. The apparatus of claim 9 wherein the wireway structure further comprises a single-piece rigid cover secured with respect to the optical-member flange portion and enclosing the flexible duct.

11. The apparatus of claim 9 wherein the chamber encloses electronic LED power circuitry.

12. The apparatus of claim 9 comprising at least two lighting sets adjacent to one another, each set including one of the optical members and its corresponding LED board, wherein:

one of the lighting sets is proximal to the wire-passage opening from the chamber with the source-to-board duct extending between the opening and such set;

each adjacent pair of the lighting sets includes a board-to-board on-board connector for each lighting set of such pair, such board-to-board on-board connectors being proximal to one another;

the flange portion of each optical member of each adjacent pair of the lighting sets defining a board-to-board flange aperture which is positioned over the corresponding board-to-board on-board connector; and a board-to-board flexible duct has two end portions each in engagement with one of such board-to-board flange apertures, the board-to-board flexible duct forming a channel for passing wires between the board-to-board on-board connectors of the adjacent pair of the lighting sets.

13. The apparatus of claim 1 comprising at least two lighting sets adjacent to one another, each set including one of the optical members and its corresponding LED board, wherein:

each adjacent pair of the lighting sets includes a board-to-board on-board connector for each lighting set of such pair, such board-to-board on-board connectors being proximal to one another;

the flange of each optical member of each adjacent pair of the lighting sets defining a board-to-board flange aperture which is positioned over the corresponding board-to-board on-board connector; and the one-piece flexible duct being a board-to-board duct which has two end portions each in engagement with one of such board-to-board flange apertures, the board-to-board flexible duct forming a channel for passing wires between the board-to-board on-board connectors of the adjacent pair of the lighting sets.

14. The apparatus of claim 13 wherein each end portion of the board-to-board flexible duct has an outward lip defining a groove receiving the edge of the corresponding board-to-board flange aperture thereby forming a seal thereabout.

15. The apparatus of claim 13 wherein the wireway structure further comprises a single-piece board-to-board rigid cover enclosing the board-to-board flexible duct and secured with respect to the flange portion of each of the optical members of the adjacent pair of the lighting sets.

16. The apparatus of claim 15 wherein the board-to-board rigid cover includes an attaching portion securing the rigid cover to the flange portions of the optical members of the adjacent pair of the lighting sets.

17. The apparatus of claim 16 wherein the attaching portion includes a resilient tab terminating with a hook positioned and configured for simultaneous snap-engagement with the flange portions of both of the optical members.

18. The apparatus of claim 17 wherein the board-to-board rigid cover is further secured with respect to each of the flange portions by a fastener extending through the board-to-board rigid cover into the corresponding flange portion.

19. The apparatus of claim 18 wherein each of the fasteners extends into a closed-end fastener receptor formed in the respective flange portion.

20. The apparatus of claim 1 wherein the at least one LED emitter comprises an array of LED light sources spaced along the board.

21. The apparatus of claim 20 wherein the optical member comprises a plurality of lenses each over a corresponding one of the LED light sources.

22. The apparatus of claim 20 wherein each LED light source comprises an array of LEDs.

23. An LED light fixture comprising:

a housing with a chamber and a wire-passage opening through which wires extend therefrom;

at least one optical member disposed over a corresponding LED board with at least one LED emitter thereon, the optical member(s) including (a) at least one optical portion corresponding to and over the at least one LED emitter and (b) a flange portion defining an aperture therethrough;

an on-board connector for connecting electrical wiring to the LED emitter(s), the on-board connector being aligned with the flange-portion aperture; and a wireway structure comprising a one-piece flexible duct which has a first end engaged with the wire-passage opening and a second end engaged with the flange-portion aperture and which forms a channel for wires to the on-board connector.

24. The LED light fixture of claim 23 comprising at least two lighting sets adjacent to one another, each set including one of the optical members and its corresponding LED board, wherein:

one of the lighting sets is proximal to the wire-passage opening from the chamber with the source-to-board duct extending between the opening and such set;

each adjacent pair of the lighting sets includes a board-to-board on-board connector for each lighting set of such pair, such board-to-board on-board connectors being proximal to one another;

the flange portion of each optical member of each adjacent pair of the lighting sets defining a board-to-board flange aperture which is positioned over the corresponding board-to-board on-board connector; and a board-to-board flexible duct has two end portions each in engagement with one of such board-to-board flange apertures, the board-to-board flexible duct forming a channel for passing wires between the board-to-board on-board connectors of the adjacent pair of the lighting sets.

25. An LED light fixture comprising:

a heat sink structure;

at least one LED board in thermal engagement with the heat sink structure, the at least one LED board having at least one LED emitter thereon;

an on-board connector on the LED board for connecting electrical wiring to the LED emitter(s);

at least one enclosing member forming with the heat sink an interior space enclosing a corresponding LED board, the rigid enclosing member defining a wiring aperture therethrough in alignment with the on-board connector; and an exterior wireway structure comprising a one-piece flexible duct which has an end portion engaged with the wiring aperture and which forms a channel for wires to the on-board connector.

26. The LED light fixture of claim 25 wherein the enclosing member comprises at least one optical portion corresponding to and over the at least one LED emitter.

27. The LED light fixture of claim 26 wherein the enclosing member is a rigid optical member having the at least one optical portion and an flange portion thereabout, the flange portion forming the wiring aperture.

28. The LED light fixture of claim 27 further including a housing with a wire-passage opening through which wires extend to the on-board connector, the one-piece flexible duct being a source-to-board duct and having a second end in engagement with the wire-passage opening of the housing, whereby wires from the chamber pass though the duct to the on-board connector.

29. The LED light fixture of claim 28 comprising at least two lighting sets adjacent to one another, each set including one of the enclosing members and its corresponding LED board, wherein:

one of the lighting sets is proximal to the wire-passage opening of the housing with the source-to-board duct extending between the opening and such set;

each adjacent pair of the lighting sets includes a board-to-board on-board connector for each lighting set of such pair, such board-to-board on-board connectors being proximal to one another;

each enclosing member of each adjacent pair of the lighting sets defining a board-to-board wiring aperture which is positioned over the corresponding board-to-board on-board connector; and a board-to-board flexible duct has two end portions each in engagement with one of such board-to-board wiring apertures, the board-to-board flexible duct forming a channel for passing wires between the board-to-board on-board connectors of the adjacent pair of the lighting sets.

30. The LED light fixture of claim 29 wherein the proximal board comprises bypass circuitry extending from the source-to-board on-board connector to the board-to-board on-board connector for connection to the adjacent LED board.

31. An LED light fixture comprising:

a mounting structure;

at least one LED emitter secured with respect to the mounting structure and defining a light-emission side of the mounting structure;

conductive paths from the at least one LED emitter to a quick-connect connector which is secured with respect to the mounting structure on the light emission side for connecting electrical wiring to the LED emitter(s);

at least one enclosing member, having interior and exterior sides, the interior side forming with the mounting structure an interior space enclosing the at least one LED emitter, the quick-connect connector being accessible through the enclosing member; and an exterior wireway structure forming a channel for wires to the quick-connect connector, the channel being spaced from the mounting structure on the light-emission side thereof and at least partially extending along the exterior side of the enclosing member.

32. The LED light fixture of claim 31 wherein:

the enclosing member defines a wiring aperture therethrough in alignment with the quick-connect connector; and the exterior wireway structure is in sealing engagement with the wiring aperture such that the channel is closed for sealed wiring connection to the quick-connect connector.

33. The LED light fixture of claim 32 wherein:

the at least one LED emitter and the quick-connect connector are on an LED board which includes the conductive paths; and the exterior wireway structure comprises a one-piece flexible duct which has an end portion engaged with the wiring aperture.

34. The LED light fixture of claim 33 wherein the enclosing member is a rigid optical member comprising (a) at least one optical portion corresponding to and over the at least one LED emitter and (b) a flange portion about the optical portion, the flange portion forming the wiring aperture.

35. The LED light fixture of claim 33 further comprising a housing with a wire-passage opening through which wires extend to the quick-connect connector, the one-piece flexible duct being a source-to-connector duct and having a second end in engagement with the wire-passage opening of the housing.

36. The LED light fixture of claim 35 comprising at least two lighting sets adjacent to one another, each set including one of the enclosing members and its corresponding at least one LED emitter, wherein:

one of the lighting sets is proximal to the wire-passage opening of the housing with the source-to-connector duct extending between the opening and such set;

each adjacent pair of the lighting sets includes a set-to-set quick-connect connector for each lighting set of such pair, such set-to-set quick-connect connectors being proximal to one another;

each enclosing member of each adjacent pair of the lighting sets defining a set-to-set wiring aperture which is positioned over the corresponding set-to-set quick-connect connector; and a set-to-set duct has two end portions each in engagement with one of such set-to-set wiring apertures, the set-to-set duct forming a channel for passing wires between the set-to-set quick-connect connectors of the adjacent pair of the lighting sets.

37. The LED light fixture of claim 36 wherein:

the at least one LED emitter and the quick-connect connector are on an LED board which includes the conductive paths; and the LED board of the proximal lighting set comprises bypass circuitry extending from the source-to-connector quick-connect connector to the set-to-set quick-connect connector for connection to the adjacent LED board.

38. The LED light fixture of claim 31 wherein the mounting structure is a heat sink in thermal engagement with the LED board.

39. The LED light fixture of claim 31 wherein the exterior wireway structure has an electrically-insulating inner surface.

40. The LED light fixture of claim 31 wherein the exterior wireway structure has an outer reflective surface, thereby to reflect LED-emitter light.

41. The LED light fixture of claim 40 wherein the exterior wireway structure has an electrically-insulating inner surface.

42. The LED light fixture of claim 41 wherein the exterior wireway structure comprises:

a one-piece flexible duct forming the channel and connected at each end for sealed wiring connection; and a single-piece rigid cover enclosing the flexible duct.

* * * * *